US007547187B2

(12) United States Patent
Senoo et al.

(10) Patent No.: US 7,547,187 B2
(45) Date of Patent: Jun. 16, 2009

(54) AXIAL TURBINE

(75) Inventors: Shigeki Senoo, Hitachi (JP); Tetsuaki Kimura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 324 days.

(21) Appl. No.: 11/350,025

(22) Filed: Feb. 9, 2006

(65) Prior Publication Data

US 2006/0222490 A1 Oct. 5, 2006

(30) Foreign Application Priority Data

Mar. 31, 2005 (JP) ..... 2005-101371

(51) Int. Cl.
*F01D 9/00* (2006.01)

(52) U.S. Cl. ..... 415/191; 415/192; 415/193; 415/208.1; 416/223 R; 416/DIG. 2

(58) Field of Classification Search ..... 415/191, 415/192, 208.1; 416/223 R, DIG. 2
See application file for complete search history.

(56) References Cited

U.S. PATENT DOCUMENTS 6,776,582 B2 * 8/2004 Segawa et al. ..... 416/223 R

FOREIGN PATENT DOCUMENTS

JP 10047009 A * 8/1996
JP 2000204903 A * 7/2000
JP 2003-27901 1/2003

* cited by examiner

*Primary Examiner*—Igor Kershteyn
(74) *Attorney, Agent, or Firm*—Mattingly & Malur, P.C.

(57) ABSTRACT

An axial turbine includes a plurality of stages, each of the plurality of stages having stationary blades adjacent to each other along the turbine circumferential direction and corresponding moving blades adjacent to each other along the circumferential direction, each of the moving blade being located downstream of a corresponding one of the stationary blades along a flow direction of a working fluid, so as to be opposed to the corresponding stationary blade. In this axial turbine, each of the stationary blades is formed so that the intersection line between the outer periphery of the stationary blade constituting a stage having moving blades longer than moving blades in a preceding stage and a plane containing the central axis of the turbine, has a flow path constant diameter portion that includes at least an outlet outer periphery of the stationary blade and that is parallel to the central axis of the turbine.

6 Claims, 11 Drawing Sheets

AXIAL TURBINE

BACKGROUND OF THE INVENTION

1. Field of the Invention

The present invention relates to an axial turbine, such as a steam turbine or a gas turbine.

2. Description of the Related Art

In the axial turbine, the stationary blades increase the velocity of a working fluid and deflect the working fluid in the rotational direction of turbine rotor. The working fluid with the rotational velocity components provides kinetic energy to moving blades and rotates the turbine. In order to induce such a flow of the working fluid for driving the turbine rotor, the height of the outlet flow path of a turbine stage measured in the radial direction of the turbine rotor is made higher than the height of the inlet flow path of the turbine stage, in conformance to the fact that the inlet of the turbine stage is higher in pressure than the outlet thereof. As a result, generally, on a stationary blade annular plane outer periphery in each stage, the flow path height monotonically increases from the inlet toward the outlet of the stage (refer to JP, A 2003-27901 for example).

SUMMARY OF THE INVENTION

In a typical turbine, since the flow path height of the stationary blade annular plane outer periphery monotonically increases from the inlet toward the outlet of the stage as described above, a flow having past the stationary blade has a velocity component in a radially outward direction. Usually, the flow having a velocity component in the radially outward direction increases in the relative velocity with respect to the moving blade, correspondingly. In the future, it is expected that elongation of turbine blades is performed for further improvement in performance, and hence the peripheral velocity in the moving blade outer periphery would be increasingly higher. However, if the elongation of turbine blades is performed without changing the current design, that is, without elongating the axial length, then, the inclination angle of the stationary blade annual plane outer periphery becomes steeper, so that a velocity component in the radially outward direction of a flow that has exited from the stationary blade increases. As a consequence, there occurs a possibility that the relative velocity of a flow entering the moving blade with respect to the moving blade may exceed the sound velocity, and turbine stage efficiency might disadvantageously decrease because of the moving blade becoming more susceptible to shock wave detriment.

The present invention is directed to an axial turbine capable of suppressing the relative velocity of a flow entering the moving blade with respect to the moving blade, and thereby improving turbine stage efficiency.

Accordingly, the present invention provides an axial turbine includes a plurality of stages, each of the plurality of stages including stationary blades adjacent to each other along the turbine circumferential direction and corresponding moving blades adjacent to each other along the circumferential direction, each of the moving blade being located downstream of a corresponding one of the stationary blades along a flow direction of a working fluid, so as to be opposed to the corresponding stationary blade, wherein each of the stationary blades is formed so that the intersection line between the outer periphery of the stationary blade constituting a stage having moving blades longer than moving blades in a preceding stage and a plane containing the central axis of the turbine, has a flow path constant diameter portion that includes at least an outlet portion of the stationary blade and that is parallel to the central axis of the turbine.

According to the present invention, it is possible to suppress the relative velocity of a flow entering the moving blade with respect to the moving blade, and thereby improve turbine stage efficiency.

DESCRIPTION OF THE PREFERRED EMBODIMENTS

Figure 1:
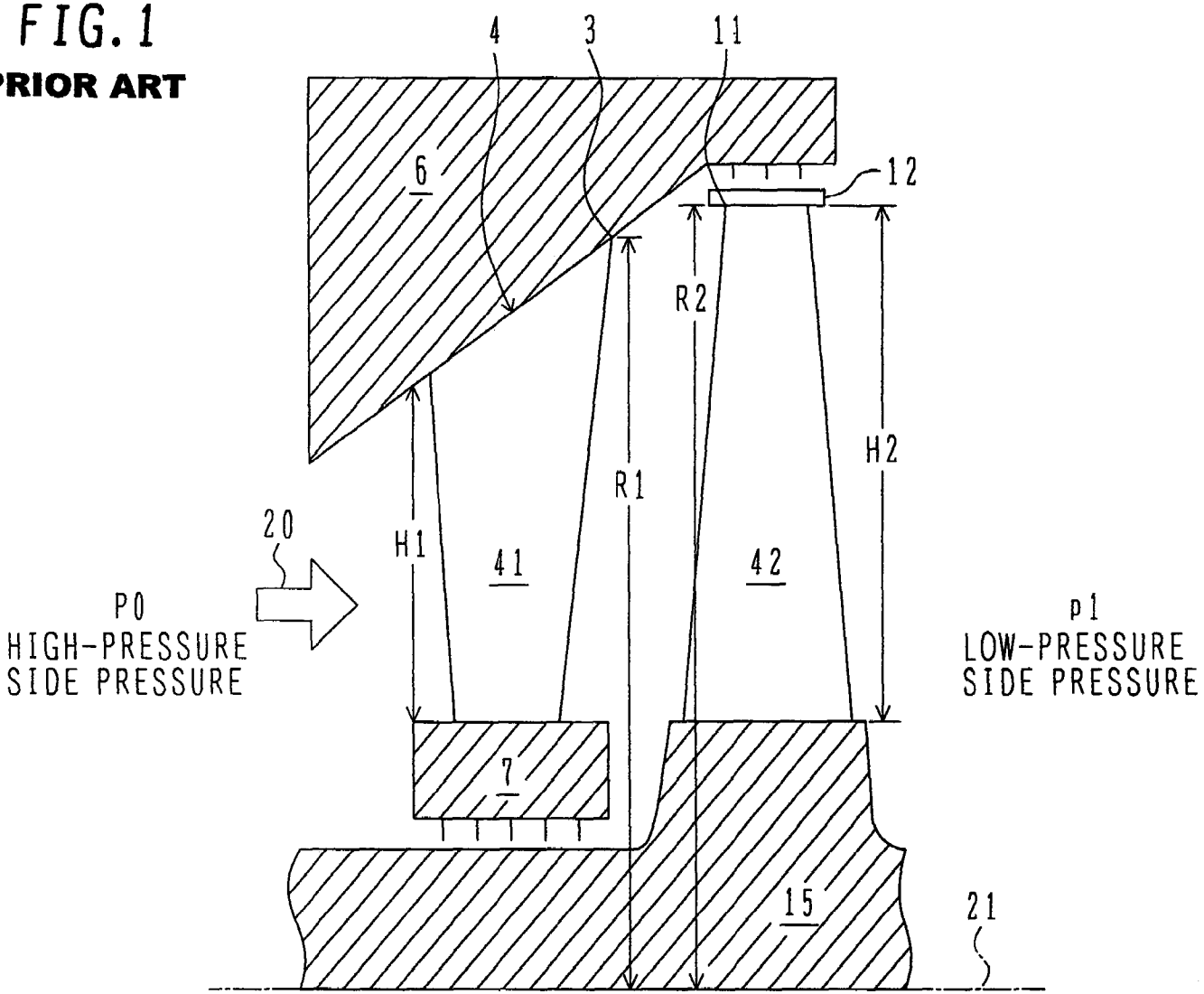
FIG. 1 PRIOR ART
FIG. 1 is a sectional view of the basic structure of a turbine stage portion of a typical axial turbine.

FIG. 1 is a sectional view of the basic structure of a turbine stage, out of a plurality of turbine stages of a typical axial turbine. As shown in FIG. 1, each of the turbine stages of the axial turbine exists between a high pressure portion P0 located on the upstream side along a flow direction of a working fluid (hereinafter referred to merely as "upstream side") and a low pressure portion p1 on the downstream side. Each of the turbine stages comprises stationary blades (in FIG. 1, only a single stationary blade is shown for the simplification of illustration) 41 fixed between an outer peripheral side diaphragm 6 and an inner peripheral side diaphragm 7 that are annularly installed in a casing (not shown), and moving blades (in FIG. 1, only a single moving blade is shown for the same reason as the forgoing) 42 installed on a turbine rotor 15 rotating about the central axis 21 of the turbine rotor 15. In each of the stages, there are moving blades 42 each located on the downstream side of a corresponding one of the stationary blades 41 along the flow direction of the working fluid (hereinafter referred to merely as "upstream side"), so as to be opposed to the corresponding stationary blade.

With these features, a flow 20 of the working fluid is induced by a pressure difference (P0−p1), and the flow 20 is increased in speed when passing through the stationary blade 41 and deflected in the turbine circumferential direction. The flow having been supplied with a circumferential velocity component by passing through the stationary blade 41 provides energy to the moving blade 42 and rotates the turbine rotor 15.

The stage inlet is higher in pressure and smaller in the specific volume of the working fluid than the stage outlet, so that the flow path height H1 at the stage inlet is lower than the flow path height H2 at the stage outlet. Therefore, the stationary blades 41 (exactly speaking, the inner peripheral surface of the outer peripheral side diaphragm 6 thereof) is formed so that, regarding an outer diameter line 4, that is, the intersection line between the outer periphery of the stationary blade 41 and a plane (meridian plane) containing the central axis 21 of the turbine, the stage flow path height becomes linearly (or monotonically) higher from the moving blade outlet in a preceding stage to the moving blade inlet of the pertinent stage. Hence, in a stage having particularly longer blades of a typical axial turbine, the radius R1 of a stationary blade outlet outer periphery 3 (the point at the stationary blade trailing edge on the outer diameter line 4, or the stationary blade outer peripheral end trailing-edge) of the stationary blade 41 is smaller compared as the radius R2 of a moving blade inlet outer periphery (moving blade outer peripheral end leading-edge) 11 of the moving blade 42. In general, if the moving blade outer peripheral end peripheral velocity Mach number, obtained by dividing a rotational peripheral velocity of the inlet outer periphery 11 of the moving blade 42 by the sound velocity in a fluid flowing into the outer peripheral end (outer periphery within a flow path effective range) of the moving blade 42 exceeds 1.0, then, there occurs a possibility that the relative velocity of the working fluid entering the moving blade 42 with respect to the moving blade 42 may becomes supersonic. If the moving blade outer peripheral end peripheral velocity Mach number exceeds 1.7, the relative velocity of the working fluid with respect to the moving blade 42 perfectly becomes supersonic.

Figure 2:
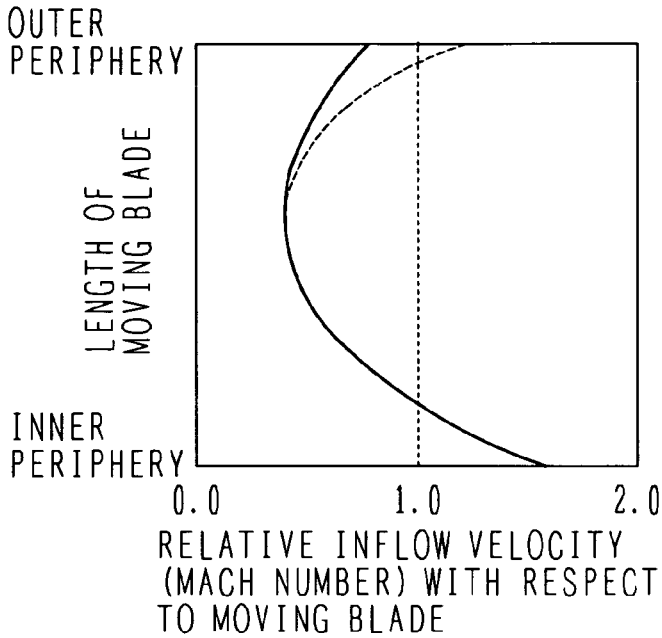
FIG. 2 is a graph showing the change, along the moving blade length direction, in a relative inflow velocity of a working fluid with respect to a moving blade.

FIG. 2 is a graph showing the change, along the length direction of the moving blade, in Mach number of the working fluid with respect to the moving blade (relative inflow velocity with respect to the moving blade).

The relative inflow velocity with respect to the moving blade in a stage in which the blade length is large and the moving blade outer peripheral end peripheral velocity Mach number exceeds 1.0, is prone to exceed 1.0 around the root and around the tip of the moving blade, as indicated by a broken line in FIG. 2. In such a case, the working fluid of which the relative velocity having become supersonic may flow into the vicinity of the root and the tip of the moving blade. Once the relative inflow velocity with respect to the moving blade has attained a supersonic velocity, flow is choked on the upstream side of the moving blade, so that the mass flow rate cannot be determined using by a throat area (minimum distance between moving blades adjacent to each other) of the moving blade. This makes it impossible to implement the flow of the working fluid as designed. Furthermore, detached shock wave formed upstream of the moving blade leading edge interferes with a boundary layer of the blade surface and causes large loss. Particularly on the tip side of the moving blade, since the annular plane area is large and the flow rate of the working fluid is high, the ratio of performance degradation due to the working fluid flowing in at a supersonic velocity is larger than in the vicinity of the root of the moving blade. As described above, when blade elongation is attempted in a typical turbine stage, there occurs a possibility that the relative inflow velocity of the working fluid with respect to the moving blade may attain a supersonic velocity, resulting in significantly reduced stage performance.

Figure 3:
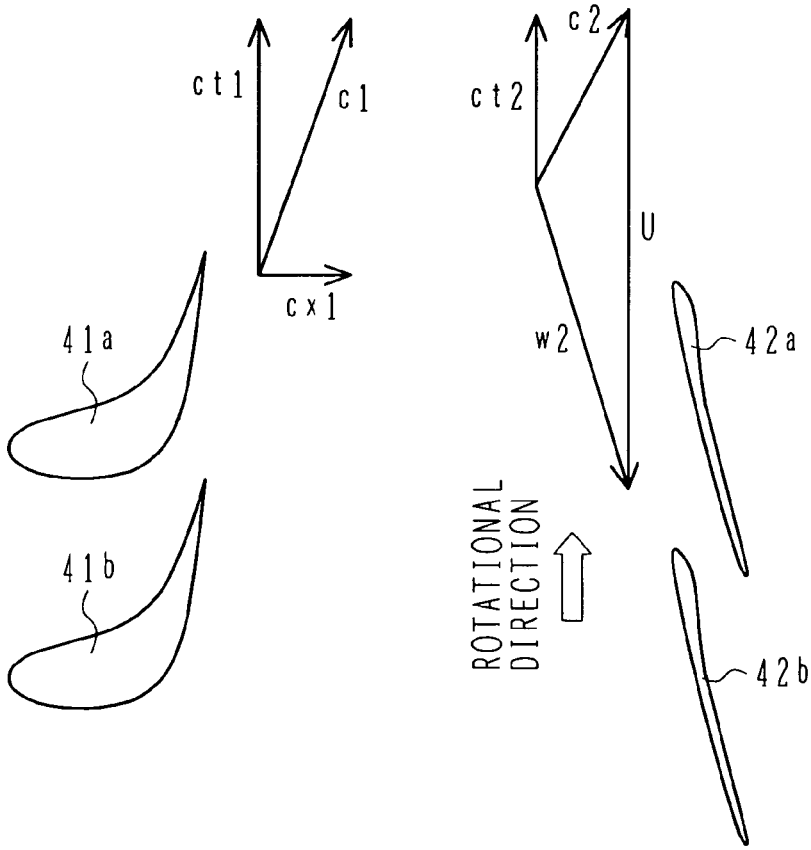
FIG. 3 is an explanatory view of the principle that a relative inflow velocity with respect to the moving blade becomes supersonic at the tip side of the moving blade in the turbine stage.

FIG. 3 is an explanatory view of the principle that the relative inflow velocity with respect to the moving blade becomes supersonic at the tip side of the moving blade in the turbine stage as shown in FIG. 1.

As shown in FIG. 3, the working fluid that has exited from a flow path formed by stationary blades 41*a* and 41*b* adjacent to each other along the circumferential direction has a flow velocity c1 at the stationary blade outlet outer periphery 3. The flow velocity c1 is composed of a swirl velocity ct1 as a peripheral velocity component, an axial flow velocity cx1 as an axial direction velocity component, and a radial velocity cr1 (not shown) as an outward velocity component in the turbine radial direction (i.e., a velocity component toward the front in the direction perpendicular to the plane of the figure). On the other hand, the flow that has passed through the stationary blades 41*a* and 41*b* at a flow velocity c1 flows into the outer peripheral side leading-edge 11 of moving blades 42*a* and 42*b* at a flow velocity c2, the moving blades 42*a* and 42*b* being moving blade adjacent to each other along the circumferential direction and opposed to the stationary blades 41*a* and 41*b*, respectively. Here, the swirl velocity component of the flow velocity c2 is assumed to be ct2.

Here, based on the law of conservation of angular momentum between the stationary blade and moving blade, the relationship between the swirl velocity component ct1 and ct2 can be represented by the following equation, using the stationary blade outer peripheral trailing-edge radius R1 and the moving blade outer peripheral leading-edge radius R2.

$$R1 \times ct1 = R2 \times ct2 \quad \text{(Equation 1)}$$

In the axial turbine shown in FIG. 1, $$R1 < R2 \quad \text{(Equation 2)}$$

Therefore, from Equations (1) and (2), $$ct1 > ct2 \quad \text{(Equation 3)}$$

In this manner, the swirl velocity ct2 at the inlet of each of the moving blades 42*a* and 42*b* is smaller than the swirl velocity ct1 at the outlet of each of the stationary blades 41*a* and 41*b*.

On the other hand, on the moving blade tip side, a peripheral velocity U of the moving blades 42*a* and 42*b* is high, and hence, as shown in FIG. 3, the relative inflow velocity w2 of the working fluid with respect to the moving blades 42*a* and 42*b* has a velocity component toward a direction opposite to the rotational direction of the moving blades 42*a* and 42*b*, contrary to the flow velocity c2. Therefore, the smaller the peripheral velocity component ct2 of the flow velocity c2, the larger is the relative inflow velocity w2 with respect to the moving blade.

Considering the above-described relationship, when a flow with the swirl velocity ct1 given by the stationary blades 41*a* and 41*b* flows into the moving blades 42*a* and 42*b*, with its flow path enlarged in diameter, while having an outward velocity component in the turbine radial direction, then, as described in Equation (3), the swirl velocity ct1 reduces to ct2 (<ct1) according to the law of conservation of angular momentum by that time, so that the relative inflow velocity w2 with respect to the moving blade increases to thereby become supersonic. That is, when attempting blade elongation, if the working fluid having passed the outer periphery of the stationary blade 41 has an outward velocity component in the turbine radial direction, this would cause the relative inflow velocity w2 with respect to the moving blade to become supersonic, resulting in severely reduced turbine stage efficiency.

As mentioned in the foregoing paragraph, an axial turbine according to an embodiment of the present invention will be described below.

Figure 4:
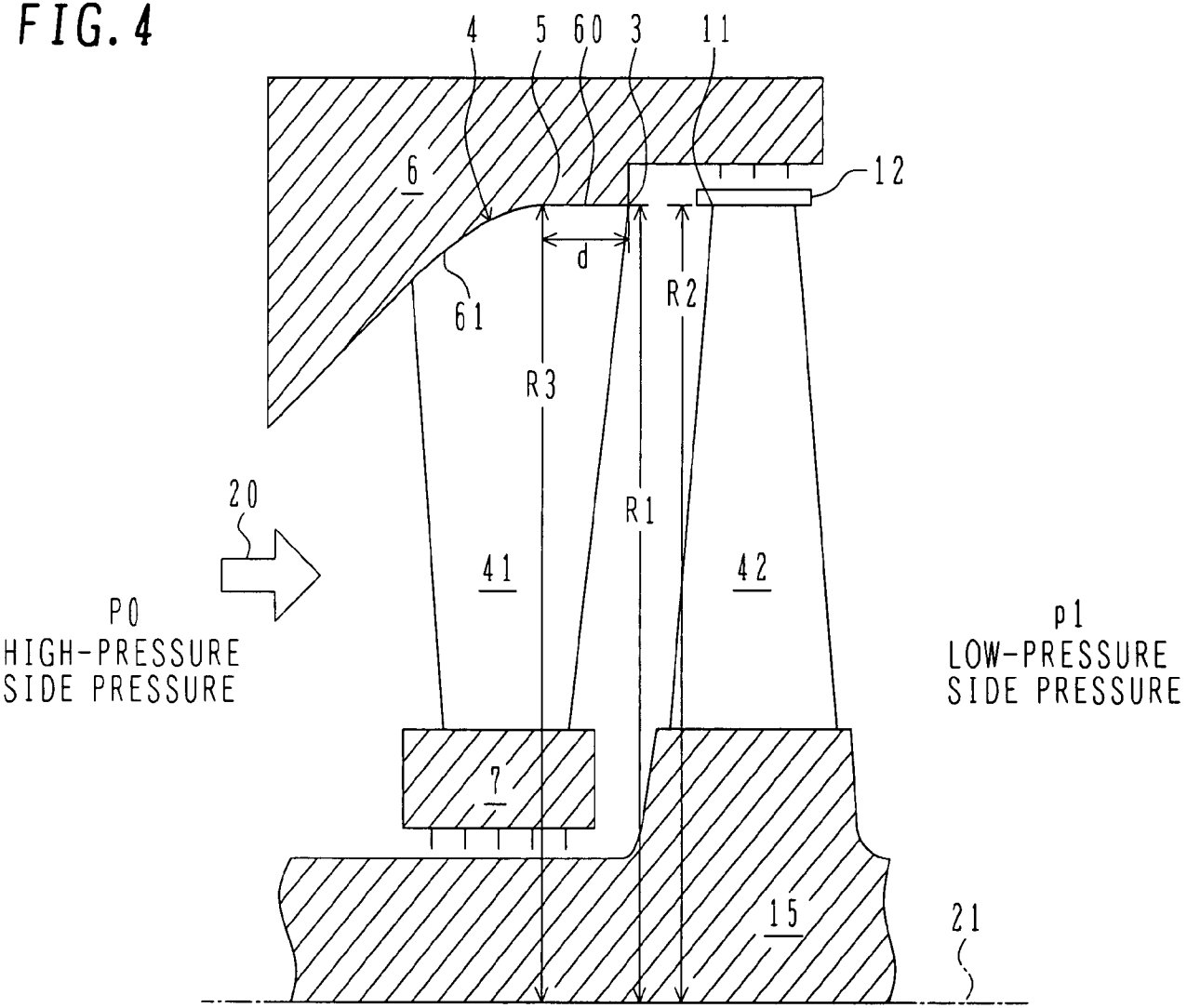
FIG. 4 is a sectional view of the main structure of an axial turbine according to an embodiment of the present invention.

FIG. 4 is a sectional view of the main structure of the axial turbine according to the embodiment of the present invention. In FIG. 4, parts that are the same as or equivalent to those in FIGS. 1 to 3 are designated by the same reference numerals, and descriptions thereof are omitted.

As shown in FIG. 4, in this embodiment, the stationary blade 41 and the diaphragm 6 thereof is formed so that the stationary blade outer diameter line 4 includes at least an outlet portion (outlet outer periphery 3) of the stationary blade 41, and that the stationary blade outer diameter line 4 has a flow path constant diameter portion 60 that is parallel to the central axis 21 of the turbine.

Specifically, when the point located at a position at an arbitrary distance d from the stationary blade outlet outer periphery 3 toward the upstream side along the stationary blade outer diameter line 4 is defined as an intermediate portion in the axial direction 5, a cylindrical annular flow path with a constant radius R3 is constructed in a section from the intermediate portion 5 in the axial direction to the stationary blade outlet outer periphery 3. That is, in this embodiment, in the identical turbine stage, the following relationship holds.

$$R1=R3 \quad \text{(Equation 4)}$$

Furthermore, the stationary blade 41 and the diaphragm 6 thereof are formed so that the stationary blade outer diameter line 4 has a flow path enlarged diameter portion 61 that inclines to the outer peripheral side in the turbine radial direction, toward the downstream side along the flow of the working fluid, and that is located on the upstream side further than the flow path constant diameter portion 60. In this embodiment, the flow path enlarged diameter portion 61 smoothly connects with the flow path constant diameter portion 60.

In addition, the height in the turbine radial direction, of the flow path equals to diameter portion 60, i.e., stationary blade outer peripheral trailing-edge radius R1, is substantially equals the height in the turbine radial direction, of the flow path effective range outer peripheral portion of the moving blade 42 in the same stage. In this embodiment, since the moving blade 42 has a connection cover 12 for connecting it with another moving blade circumferentially adjacent thereto, the flow path effective range outer peripheral portion of the moving blade 42 is positioned at the height of the inner peripheral surface of the connection cover 12. In this case, the height in the turbine radial direction, of the flow path effective range outer peripheral portion of the moving blade 42 is the moving blade outer periphery leading-edge radius R2. Therefore, in this embodiment, the following relationship is obtained.

$$R1=R2 \quad \text{(Equation 5)}$$

Here, the turbine stage shown in FIG. 4 has a moving blade 42 longer than that in a preceding stage. In a stage including the flow path constant diameter portion 60, the blade length is assumed to be large. Specifically, it is assumed that the above-described moving blade 42 has a blade length in a range such that the moving blade tip peripheral velocity Mach number, obtained by dividing a rotational velocity of the tip of the moving blade 42 by the sound velocity in the working fluid flowing into the tip of the moving blade 42 during operation, may exceed 1.0.

Figure 5:
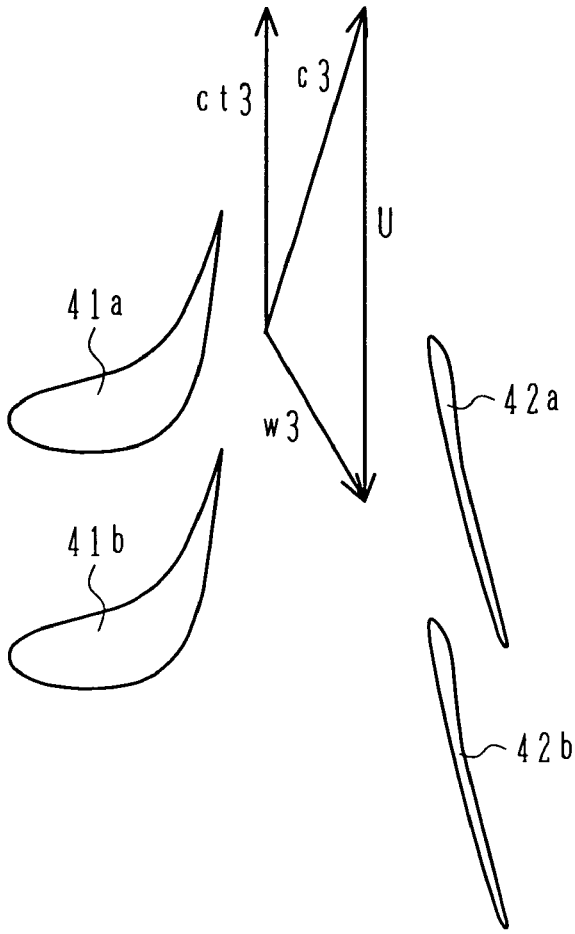
FIG. 5 is a schematic diagram showing the relative inflow velocity with respect to the moving blade in the axial turbine according to the embodiment of the present invention.

According to this embodiment, in such a turbine stage, the annular flow path of the working fluid in the vicinity of the stationary blade outlet is a cylindrical flow path that meets the condition: R3=R1. As a result, the working fluid having passed through the stationary blade 41 becomes a flow substantially parallel to the central axis of the turbine, the flow having no outward velocity component in the turbine radial direction. As shown in FIG. 5, therefore, in the axial turbine according to this embodiment, swirl velocity ct3 of a flow with flow velocity c3 which flow has exited from the stationary blades 41*a* and 41*b*, flows into the moving blades 42*a* and 42*b* without virtually changing the flow velocity c3, because there occurs no deceleration of the flow due to the diametrical enlargement of its flow path. As a result, the relative inflow velocity w3 with respect to the moving blade can be reduced lower than the sound velocity, so that a flow pattern as designed can be implemented. This reduction in the relative inflow velocity w3 with respect to the moving blade to a lower value than that of the sound velocity enables a significant reduction in shock wave loss.

Also, in this embodiment, since stationary blade outer peripheral trailing-edge radius R1 is approximately equals to the moving blade outer peripheral leading-edge radius R2, the working fluid having passed through the stationary blade outer periphery and flowing substantially parallel to the central axis 21 of the turbine, flows into the moving blade outer periphery. Hence, it is possible to allow the working fluid to flow into the flow path effective range in a balanced manner, and make full use of the performance of an elongated moving blade 42 to the greatest extent possible.

Figure 6:
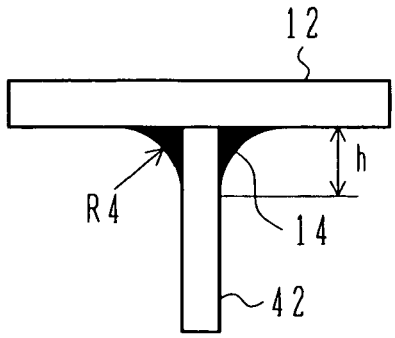
FIG. 6 is an enlarged view of the tip of the moving blade provided with a connection cover, in the embodiment of the present invention.

FIG. 6 is an enlarged view of the tip of the moving blade 42, provided with a connection cover 12.

As described above, at the tip of the moving blade 42, there is provided the connect cover 12 for connecting moving blades adjacent to each other along the circumferential direction. At the joint between the connection cover 12 and the moving blade 42, there is provided a rounded portion (buildup portion) 14 in order to avoid excessive stress concentration. In this case, the region from the tip of the moving blade 42 to a rounded portion 14 with a height h, on the inner peripheral side in the turbine radial direction, is different in blade shape from one that has been hydrodynamically designed, and hence it is not necessarily effective as a substantial flow path. Therefore, the flow path effective range outer peripheral portion of the moving blade 42 is assumed to be located between a height position of the inner peripheral surface in the turbine redial direction, of the connection cover 12, and a position located further toward the inner peripheral side in the turbine radial direction than the above-described position by the height h of the rounded portion 14.

Therefore, taking even the rounded portion 14 in the joint between the moving blade 42 and the connection cover 12 into consideration from an aerodynamic viewpoint, the stationary blade outer peripheral trailing-edge radius R1, for which an effective length of the moving blade 42 is used to the greatest extent possible, is not required to be precisely equalized with the moving blade outer peripheral leading-edge radius R2, but it suffices only to satisfy the following relationships:

$$R2=R3 \quad \text{(Equation 6)}$$

$$0 \leqq (R2-R1) < h \quad \text{(Equation 7)}$$

If the moving blade 42 has no connection cover 12, that is, the tip of the moving blade 42 is a free end, the flow path effective range outer peripheral portion of the moving blade 42 is the tip (outer periphery) of the moving blade 42. Therefore, the stationary blade outer peripheral trailing-edge radius R1, for which the moving blade effective length is used to the greatest extent possible, becomes equal to the moving blade outer peripheral leading-edge radius R2, so that, by satisfying the Equations (4) and (5), it is possible to reduce the relative inflow velocity with respect to the moving blade to a lower value than the sound velocity, and use the effective length of the moving blade 42 to the greatest extent possible.

Figure 7:
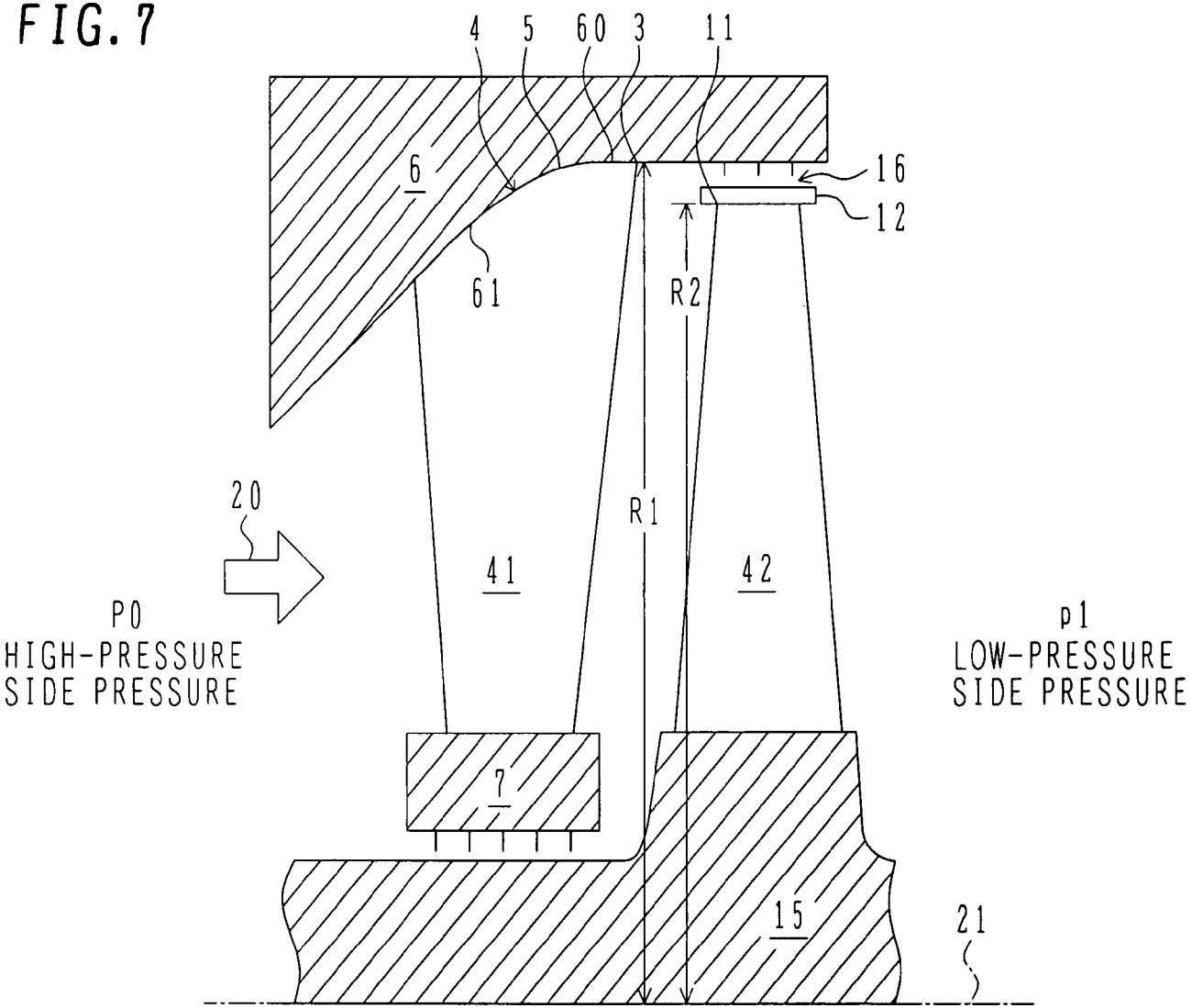
FIG. 7 is a sectional view of a comparative example of the axial turbine according to the embodiment of the present invention.

As shown in FIG. 7, when the stationary blade outer peripheral trailing-edge radius R1 is larger than the moving blade outer peripheral leading-edge radius R2, the relative inflow velocity w3 with respect to the moving blade at the moving blade inlet 11 can be reduced to a subsonic velocity, but a flow that has passed through the outer periphery of the stationary blade 41 flows toward a seal spacing 16 formed between the tip (to be exact, the outer periphery of the connection cover 12) of the moving blade 42 and the stationary body. Herein, the flow that has passed through the outer periphery of the stationary blade 41 unfavorably passes through the seal spacing 16, and the flow cannot be effectively used for rotating the turbine rotor 15. Hence, in order to use the effective length of the moving blade 42 to the greatest extent possible, it is preferable to satisfy the Equation (5) or (7).

The above-described axial turbine according to this embodiment can suppress more effectively the relative inflow velocity with respect to the moving blade by variously changing design. Hereinafter, modifications in which such effective arrangements are combined will be successively described.

Figure 8:
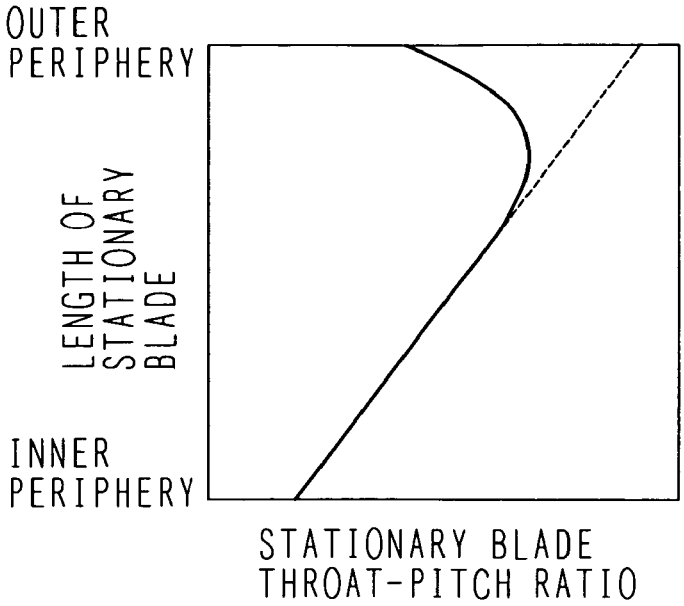
FIG. 8 is a graph showing the change, along the blade length direction, in the shape of a stationary blade of an axial turbine according to a first modification of the present invention, wherein the change in shape is represented by a throat-pitch ratio.

FIG. 8 is a graph showing the change in shape of the stationary blade 41 in its length direction, in a first modification of the present invention, wherein the change of shape is represented by a throat-pitch ratio.

With respect to the axial turbine according to the embodiment shown in FIG. 4, the relative inflow velocity with respect to the moving blade can be further reduced by forming the stationary blade 41, as indicated by a solid line in FIG. 8, by giving torsion to the stationary blade 41 so that the ratio of the stationary blade throat "s" to the pitch "t", i.e., s/t becomes smaller on the outer periphery side of the stationary blade than on the intermediate portion in the length direction thereof.

Figure 9:
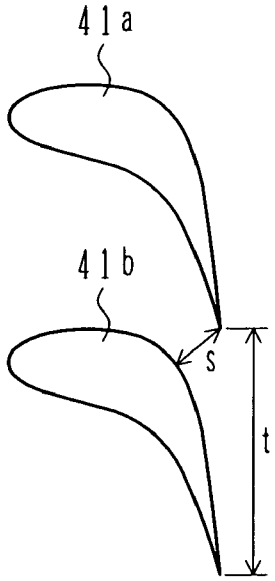
FIG. 9 is a sectional view of the stationary blade of the axial turbine according to the first modification of the present invention.

Here, the stationary blade throat "s" refers to a flow path portion that has the smallest area in a flow path formed between the stationary blades 41*a* and 41*b* adjacent to each other along the circumferential direction as shown in FIG. 9, that is, the smallest spacing portion between the stationary blades 41*a* and 41*b*. On the other hand, the pitch "t" refers to a distance between the stationary blades 41*a* and 41*b* in the circumferential direction.

Figure 10:
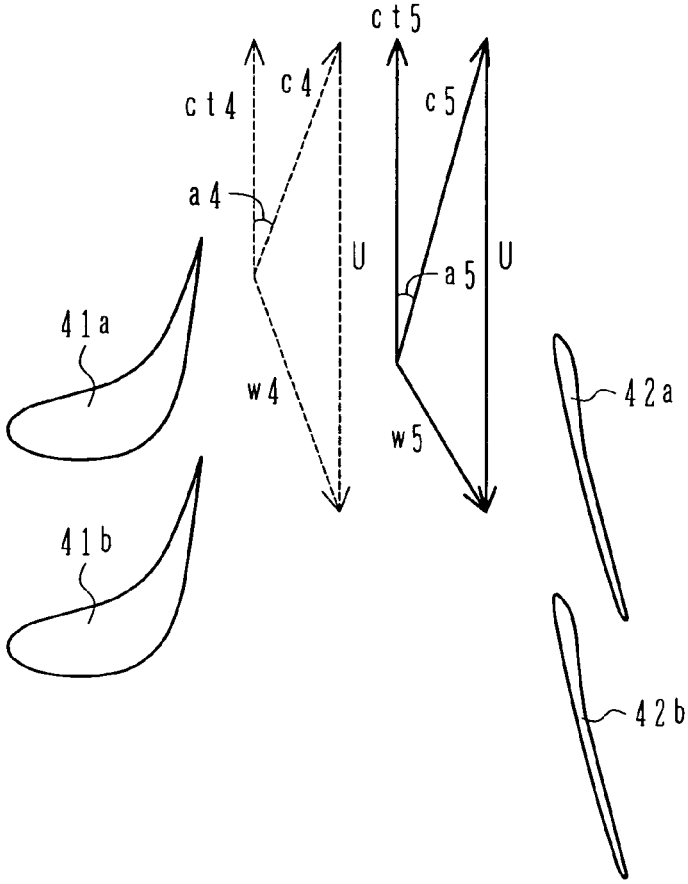
FIG. 10 is a schematic diagram showing the relative inflow velocity with respect to the moving blade in the axial turbine according to the first modification of the present invention.

In general, the throat-pitch ratio s/t is designed so as to be small on the blade inner peripheral side and large on the blade outer peripheral side, as indicated by a broken line in FIG. 8. When the moving blade tip peripheral velocity Mach number exceeds 1.0, by forming the stationary blade 41 so as to make small the throat-pitch ratio s/t on the outer peripheral side, in addition to the fulfillment of the condition of the Equation (4), a stationary blade discharge angle of the working fluid becomes as small as a5 (<a4), as shown in FIG. 10. Here, a4 is a stationary blade discharge angle of the working fluid when using the stationary blade shape indicated by a broken line in FIG. 8. By a reduced amount of the stationary blade throat "s", the swirl velocity ct5 of flows with a flow velocity c5 which flows has exited from the stationary blades 41*a* and 41*b* becomes higher than a swirl velocity ct4 of the working fluid when using the stationary blade shape indicated by the broken line in FIG. 8. Thereby, the relative velocity w4 with respect to the moving blade in this modification can be made lower than the relative velocity w5 of the working fluid with respect to the moving blade when using the stationary blade shape indicated by the broken line in FIG. 8. That is, this modification can make lower the relative velocity with respect to the moving blade as compared with that of the axial turbine in FIG. 4.

Figure 11:
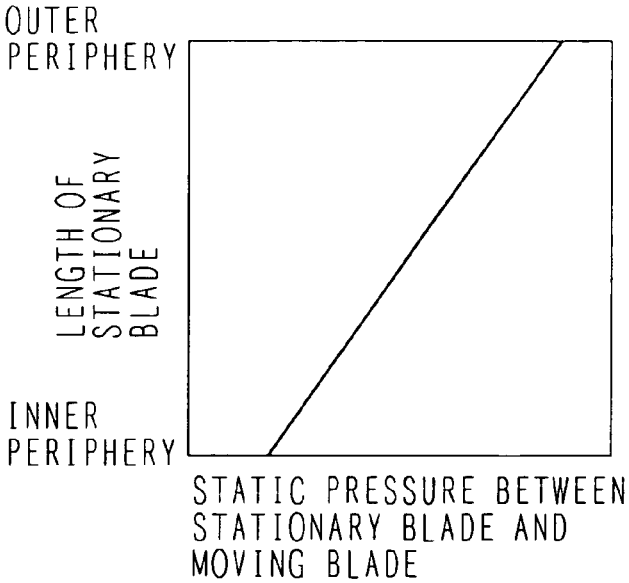
FIG. 11 is a graph showing the change, along the blade length direction, in the static pressure between the stationary blade and moving blade in the first modification of the present invention.

FIG. 11 is a graph showing the change, along the blade length direction, in static pressure between the stationary blade and the moving blade in the turbine stage.

Figure 12:
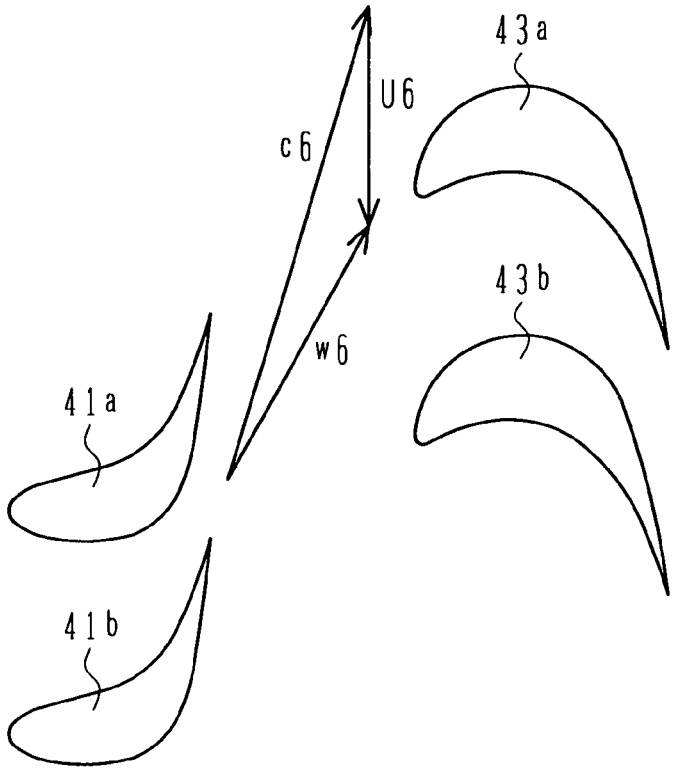
FIG. 12 is a schematic diagram showing the relative inflow velocity with respect to the moving blade on the moving blade inner peripheral side, in the first modification of the present invention.

As shown in FIG. 11, the static pressure between the stationary blade and moving blade in the turbine stage is higher on the outer peripheral side and lower on the inner peripheral side, due to a vortical flow caused by it passing through the stationary blade. As a consequence, on the inner peripheral side where the peripheral velocity of the moving blade is low, the stationary blade outflow velocity c6 becomes higher than a moving blade peripheral velocity U6 contrary to the outer peripheral side, as shown in FIG. 12, so that the relative velocity w6 with respect to the moving blade becomes supersonic.

Figure 13:
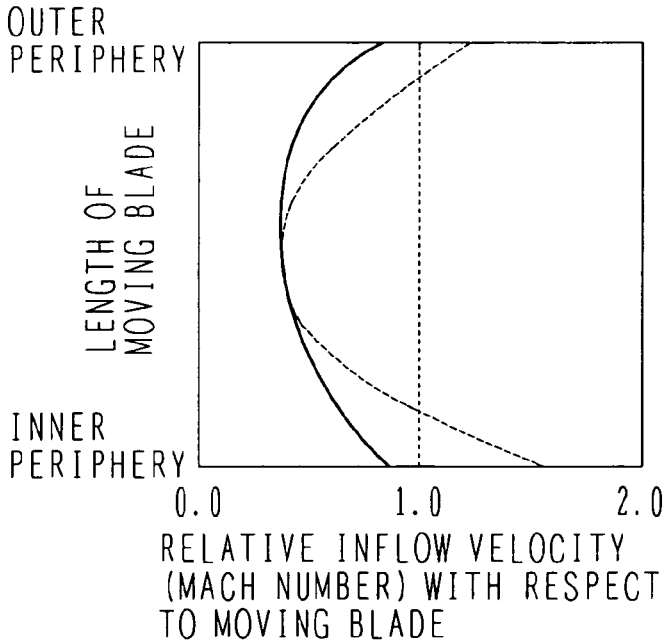
FIG. 13 is a graph showing the change, along the blade length direction, in the relative inflow velocity of the working fluid with respect to the moving blade in the first modification of the present invention.

FIG. 13 is a graph showing the change, along the blade length direction, in the inflow relative velocity (Mach number) of the working fluid with respect to the moving blade. In FIG. 13, the broken line indicates the change, along the blade length direction, in the moving blade inflow relative velocity (Mach number) with respect to moving blade, when blade elongation is performed in a typical axial turbine. As can be seen from this graph, when blade elongation is performed in a typical axial turbine, the inflow relative velocity with respect to the moving blade might exceed the sound velocity not only on the outer peripheral side but also on the inner peripheral side of the moving blade, by the factors described in FIGS. 11 and 12. A countermeasure to prevent the supersonic inflow of the working fluid into the moving blade outer peripheral side, is to reduce the outward velocity component in the turbine radial direction, of the flow that has passed through the stationary blade outer peripheral side, as described above.

Figure 14:
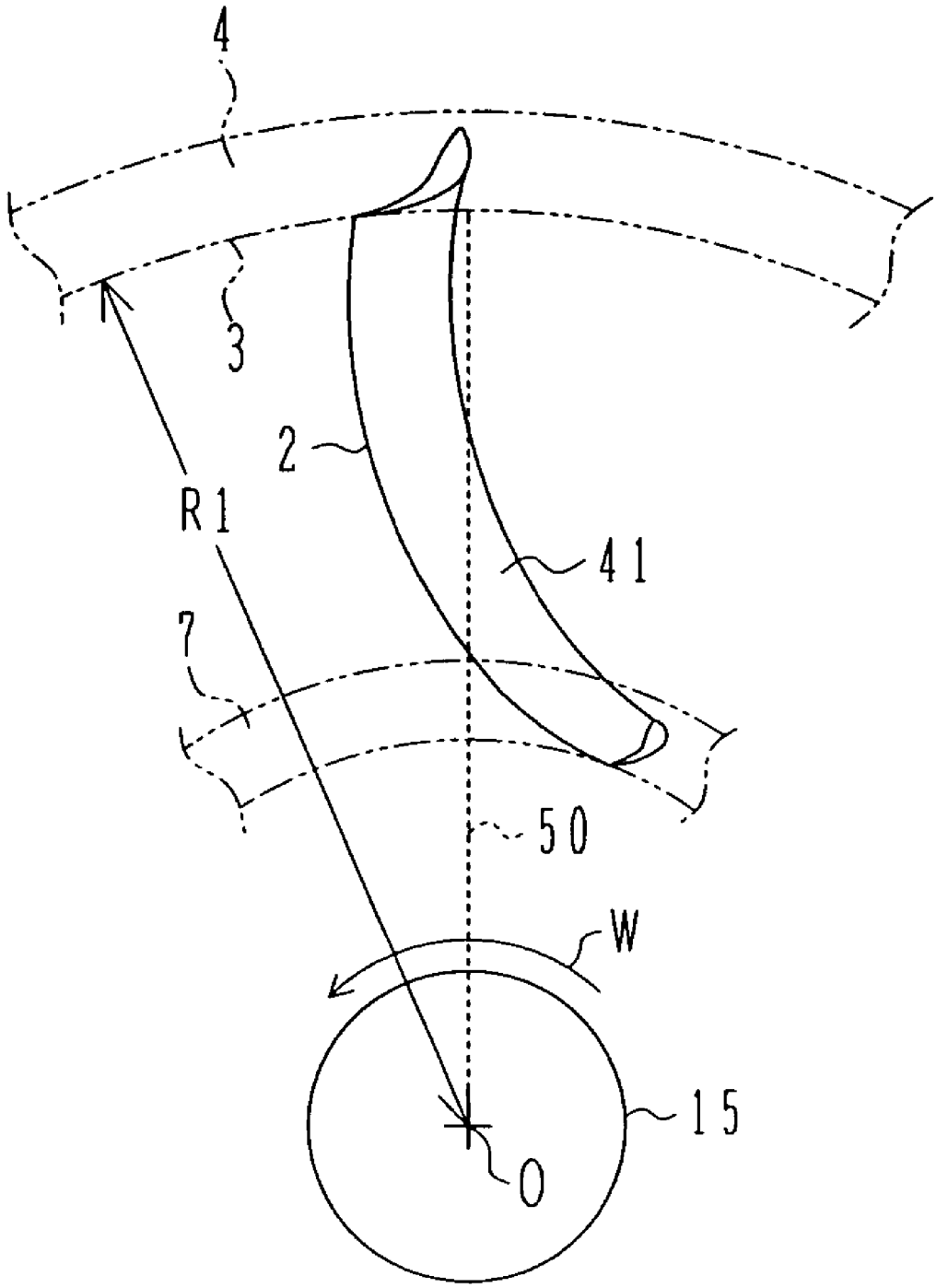
FIG. 14 is a schematic view showing the construction of a stationary blade according to a second modification of the present invention, the stationary blade being used for reducing a supersonic inflow of the work fluid into the inner peripheral side of the moving blade.

FIG. 14 is a schematic view showing the construction of a stationary blade according to a second modification of the present invention, the stationary blade being used for reducing a supersonic inflow of the working fluid into the moving blade inner peripheral side.

As shown in FIG. 14, the stationary blade 41 is formed in a bowed shape so that the trailing edge 2 of the intermediate portion in the blade length direction protrudes in the moving blade rotational direction W. Although the stationary blade 41 is bowed in this example, it may also be formed in a bent shape so that the trailing edge 2 of the intermediate portion in the blade length direction protrudes in the moving blade rotational direction W. In either case, the outer peripheral side of the stationary blade 41 extends substantially in the turbine radial direction, and the inner periphery side of the stationary blade 41 inclines to the moving blade rotational direction W toward the outside in the turbine radial direction, with respect to a reference line 50 extending along the turbine radial direction.

By bowing (or bending) the stationary blade 41 as shown in FIG. 14, a pressure gradient that generates a pressure increase in the radially inward direction occurs on the inner peripheral side, so that an inner peripheral side static pressure between the stationary blade and moving blade in the turbine stage increases. As a result, the stationary blade outlet velocity c6 shown in FIG. 12 can be reduced, which allows the relative velocity w6 with respect to the moving blade to be reduced lower than the sound velocity. Therefore, by combining the stationary blade construction shown in FIG. 14 with that according to the embodiment in FIG. 4, the relative inflow velocity with respect to the moving blade can be reduced lower than the sound velocity in all region along the moving blade length direction, as indicated by the solid line in FIG. 13, even if a further blade elongation is performed. This makes it possible to implement more reliably a flow pattern as designed, thereby resulting in more reduced shock wave loss.

Figure 15:
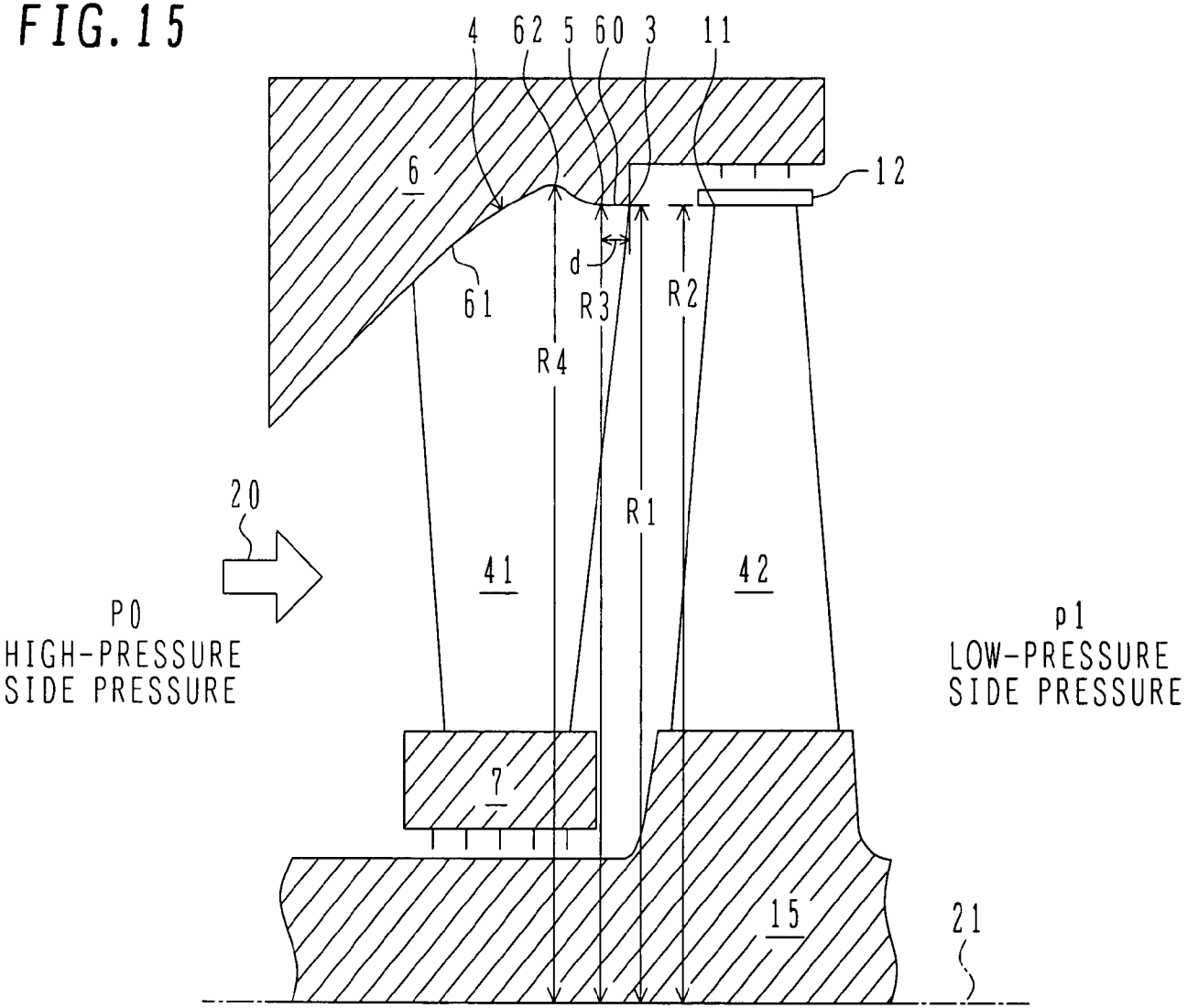
FIG. 15 is a sectional view of the main structure of an axial turbine according to a third modification of the present invention.

FIG. 15 is a sectional view of the main structure of an axial turbine according to a third modification of the present invention.

As shown in FIG. 15, in this example, the stationary blade 41 and the outer peripheral side diaphragm 6 are formed so as to have a flow path reduced diameter portion 62 that passes outer side in turbine radial direction further than the flow path constant diameter portion 60, and that contracts a flow path toward the flow path constant diameter portion 60.

Specifically, the flow path reduced diameter portion 62 is located between the flow path enlarged diameter portion 61 and the flow path constant diameter portion 60, and is supplied with a curvature that is convex upwardly in the turbine radial direction. The flow path reduced diameter portion 62 is inflected in the vicinity of a boundary with the flow path constant diameter portion 60, and smoothly connects with the flow path constant diameter portion 60. With respect to the flow path enlarged diameter portion 61, the flow path reduced diameter portion 62 is directly contiguous. The radius R4 of the outermost periphery of the flow path reduced diameter portion 62 satisfies the following relationship.

$$R4>R3 \quad \text{(Equation 8)}$$

Other constructions are the same as those in FIG. 4.

Figure 16:
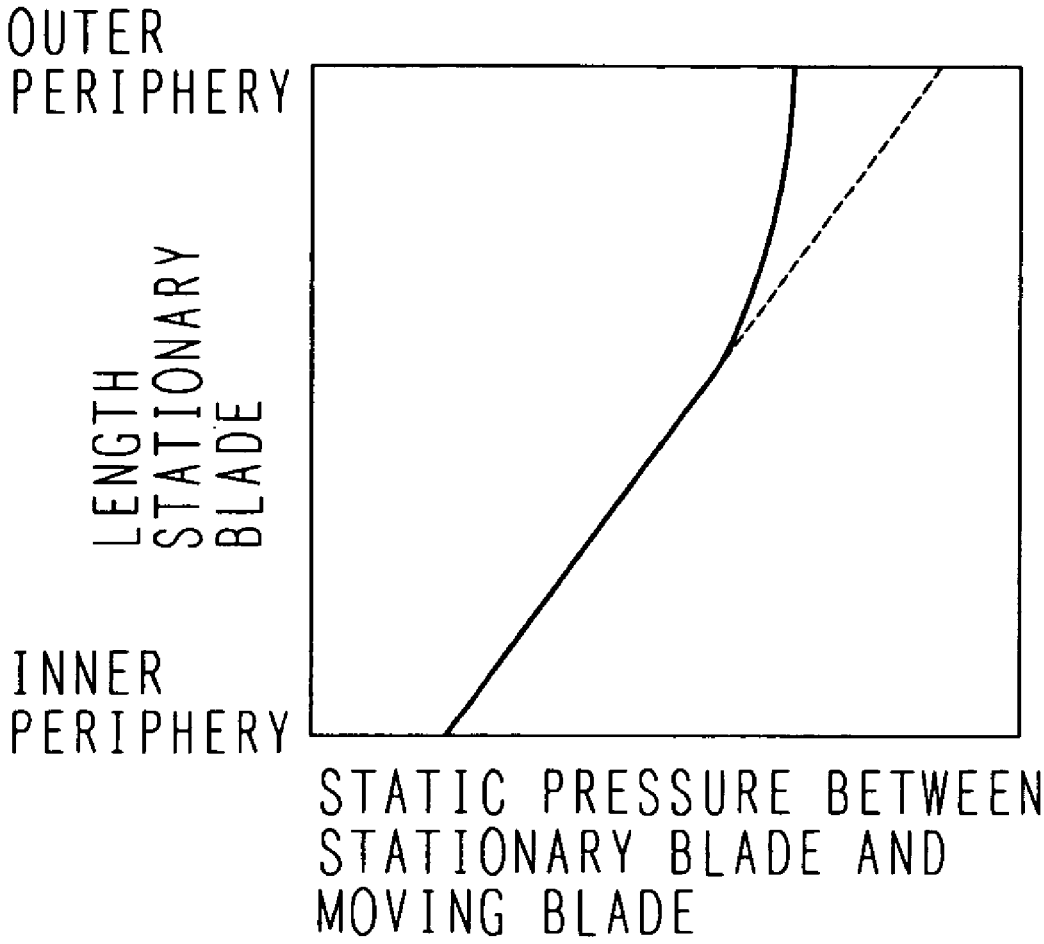
FIG. 16 is a graph showing the change, along the blade length direction, in the static pressure between the stationary blade and moving blade in the axial turbine according to the third modification of the present invention.

Because the flow passing through the stationary blade outer peripheral side flows along the stationary blade outer diameter line 4, it is once supplied with a curvature that is convex toward the inner peripheral side in the turbine radial direction when passing through the flow path reduced diameter portion 62. By giving to the flow such a curvature that is convex toward the inner peripheral side, it is possible to release the effect of the flow attempting to expand toward the outer peripheral side in the turbine radial direction under a centrifugal force, between the stationary blade 41 and the moving blade 42 in the turbine stage. As can be seen from FIG. 16, which is a graph showing the change, along the blade length direction, in the static pressure between the stationary blade and moving blade, the static pressure between the stationary blade and moving blade of a typical axial turbine increases from the inner peripheral side toward the outer peripheral side in the blade length direction, as indicated by a broken line in FIG. 16. In contrast, in the static pressure distribution between the stationary blade and moving blade in the axial turbine with the construction shown in FIG. 15, an increase in static pressure is suppressed in the region on the outer peripheral side in the turbine radial direction, as indicated by a solid line in FIG. 16. Therefore, by combining the construction shown in FIG. 15 with that according to the embodiment in FIG. 4, an effect similar to that by the construction in FIG. 4 can be produced, as well as the velocity of a flow exiting from the stationary blade outer peripheral side can be more increased, leading to further reduction in the relative inflow velocity with respect to the moving blade.

In the foregoing descriptions, while the case where the flow path enlarged diameter portion 61 is provided on the stationary blade outer diameter line 4 has been exemplified with reference to the several figures, it suffices only that there is provided the flow path constant diameter portion 60 including at least the stationary blade outlet outer periphery 3, as long as the outward velocity component in the turbine radial direction of a flow having passed through the stationary blade is suppressed. Hence, the flow path enlarged diameter portion 61 is not necessarily required to be provided on the stationary blade outer diameter line 4, but it may be provided between the stationary blade inlet and the moving blade outlet in a preceding stage depending on the circumstances. In this case, a similar effect is produced, as well.

Furthermore, while the case where the stationary blade outer peripheral trailing-edge radius R1 is substantially equalized with the moving blade outer peripheral leading-edge radius R2 (or moving blade effective length outer peripheral radius) has been exemplified with reference to the several figures, this condition is not necessarily required to be satisfied in design, as long as the outward velocity component in the turbine radial direction of a flow having passed through the stationary blade is suppressed. Hence, as long as the relative inflow velocity with respect to the moving blade is reduced lower than the sound velocity without giving to the flow any outward velocity component in the radial direction, it suffices only that the flow path constant diameter portion 60 is provided at least on the downstream side of the stationary blade outer diameter line 4. Also, the relationship between the stationary blade outer peripheral trailing-edge radius R1 and the moving blade outer peripheral leading-edge radius R2 (or moving blade effective length outer peripheral radius) is not necessarily required to be within the range of Equations (5) or (6).

What is claimed is:

1. An axial turbine comprising:

a plurality of stages, each of the plurality of stages including stationary blades adjacent to each other along the turbine circumferential direction and corresponding moving blades adjacent to each other along the circumferential direction, each of the moving blades being located downstream of a corresponding one of the stationary blades along a flow direction of a working fluid, so as to be opposed to the corresponding stationary blade, wherein each of the stationary blades is formed so that the intersection line between the outer periphery of the stationary blade constituting a stage having moving blades longer than moving blades in a preceding stage and a plane containing the central axis of the turbine, has a flow path constant diameter portion that includes at least an outlet portion of the stationary blade and that is parallel to the central axis of the turbine, wherein a height of the flow path constant diameter portion in the turbine radial direction substantially equals a height in the turbine radial direction, of a flow path effective range outer peripheral portion of the moving blade in the stage, and wherein the stationary blade is formed so that the intersection line between the outer periphery thereof and a plane containing the central axis of the turbine has a flow path enlarged diameter portion that inclines to the outer peripheral side in the turbine radial direction, toward the downstream side along the flow direction of the working fluid, and that is located upstream of the flow path constant diameter portion.

2. The axial turbine according to claim 1 wherein, when the moving blade has a connection cover for connecting it with another moving blade adjacent thereto along the circumferential direction of the axial turbine, the flow path effective range outer peripheral portion of the moving blade is located between a height position of the inner peripheral surface of the connection cover, and a position located further toward the inner peripheral side in the turbine radial direction than the height position by the height of an rounded portion at the joint between the connection cover and the moving blade.

3. The axial turbine according to claim 1, wherein, when the tip of the moving blade is a free end, the flow path effective range outer peripheral portion of the moving blade is the tip of the moving blade.

4. The axial turbine according to claim 1, wherein the stationary blade is formed so that the value obtained by dividing a minimum gap between stationary blades adjacent to each other along the circumferential direction of the axial turbine by a distance in the circumferential direction between the stationary blades, becomes smaller on the outer peripheral side of the stationary blade than the intermediate portion of the stationary blade in the length direction thereof.

5. The axial turbine according to claim 1, wherein the stationary blade is formed so as to incline to the rotational direction of the moving blade toward the peripheral side in the turbine radial direction, and so as to be bowed or bent in a manner such that the intermediate portion of the stationary blade in the length direction thereof protrudes in the rotational direction of the moving blade.

6. An axial turbine comprising:

a plurality of stages, each of the plurality of stages including stationary blades adjacent to each other along the turbine circumferential direction and corresponding moving blades adjacent to each other along the circumferential direction, each of the moving blade being located downstream of a corresponding one of the stationary blades along a flow direction of a working fluid, so as to be opposed to the corresponding stationary blade, wherein each of the stationary blades is formed so that the intersection line between the outer periphery of the stationary blade constituting a stage having moving blades longer than moving blades in a preceding stage and a plane containing the central axis of the turbine, has a flow path constant diameter portion that includes at least an outlet portion of the stationary blade and that is parallel to the central axis of the turbine, and wherein the stationary blade is formed so that the intersection line between the outer periphery thereof and a plane containing the central axis of the turbine has a flow path reduced diameter portion that passes to an outer side in the turbine radial direction further than the flow path constant diameter portion, and that contracts the flow path toward the flow path constant diameter portion.

* * * * *